US008844482B2

(12) United States Patent
Heywood et al.

(10) Patent No.: US 8,844,482 B2
(45) Date of Patent: Sep. 30, 2014

(54) CAMSHAFT WITH CAMSHAFT ADJUSTER

(75) Inventors: Jonathan Heywood, Chemnitz (DE); Sebastian Wappler, Chemnitz (DE); Mario Lindner, Chemnitz (DE)

(73) Assignee: ThyssenKrupp Presta TecCenter AG, Eschen (LI)

( * ) Notice: Subject to any disclaimer, the term of this patent is extended or adjusted under 35 U.S.C. 154(b) by 302 days.

(21) Appl. No.: 13/387,975

(22) PCT Filed: Jul. 10, 2010

(86) PCT No.: PCT/EP2010/004219
§ 371 (c)(1),
(2), (4) Date: Sep. 6, 2012

(87) PCT Pub. No.: WO2011/060840
PCT Pub. Date: May 26, 2011

(65) Prior Publication Data

US 2013/0068180 A1 Mar. 21, 2013

(30) Foreign Application Priority Data

Jul. 31, 2009 (DE) ..... 10 2009 035 632

(51) Int. Cl.

| | |
|---|---|
| ***F01L 1/34*** | (2006.01) |
| ***F01L 1/02*** | (2006.01) |
| ***F01L 1/344*** | (2006.01) |
| ***F01L 9/04*** | (2006.01) |
| *F01L 1/047* | (2006.01) |

(52) U.S. Cl.
CPC . *F01L 9/04* (2013.01); *F01L 1/344* (2013.01); *F01L 1/3442* (2013.01); *F01L 2101/00* (2013.01); *F01L 2001/34433* (2013.01); *F01L 2001/34426* (2013.01); *F01L 2001/0475* (2013.01); *F01L 2001/3443* (2013.01); *F01L 2820/041* (2013.01)
USPC ..... 123/90.17; 123/90.27

(58) Field of Classification Search
USPC ..... 123/90.15, 90.17
See application file for complete search history.

(56) References Cited

U.S. PATENT DOCUMENTS 4,967,701 A 11/1990 Isogai et al.
5,247,914 A 9/1993 Imai et al.

(Continued)

FOREIGN PATENT DOCUMENTS

DE 35 34 412 A1 4/1986
DE 10 2005 053 187 A1 5/2007

(Continued)

OTHER PUBLICATIONS

International Preliminary Report on Patentability in International Application No. PCT/EP2010/004219 dated Feb. 7, 2012.

(Continued)

*Primary Examiner* — Thomas Denion
*Assistant Examiner* — Steven D Shipe
(74) *Attorney, Agent, or Firm* — Crowell & Moring LLP

(57) ABSTRACT

A camshaft for actuating the gas exchange valves of an internal combustion engine. The camshaft includes a camshaft tube, a hydraulic camshaft adjuster, a valve for controlling the hydraulic fluid supplied to the camshaft adjuster and an actuation device, arranged in the interior of the camshaft tube, for actuating the valve. The actuation device is secured against displacement in the axial direction. The camshaft is lightweight and functional elements in addition to the actuation device and optionally the valve can be integrated into the interior of the camshaft. It should furthermore be possible to arrange an oil or vacuum pump at the end of the camshaft opposite the camshaft adjuster, the pump being drivable by the camshaft. The actuation device is designed as an electromagnetic, piezoelectric or electrical actuator and is connected to the camshaft tube such that they rotate together.

7 Claims, 5 Drawing Sheets

(56) References Cited

U.S. PATENT DOCUMENTS

Figure 1:
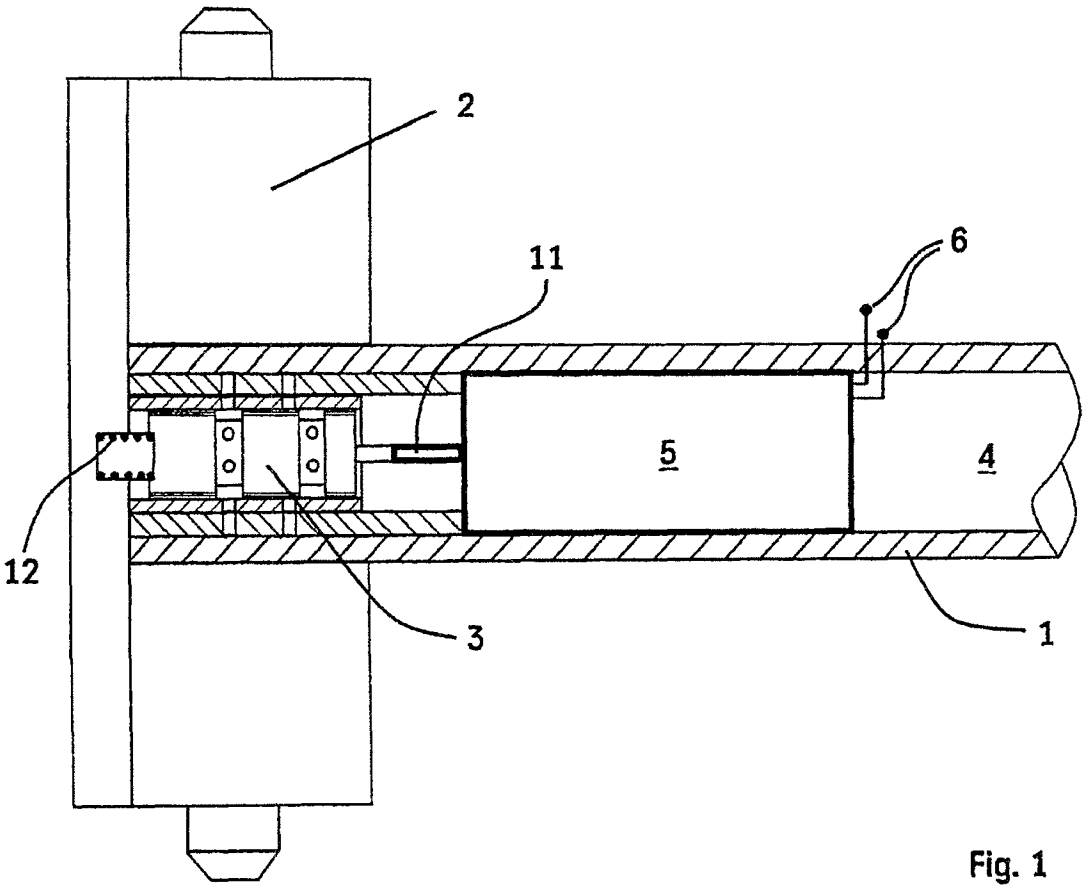

2011/0265717 A1* 11/2011 Fritz et al. ..... 118/620
2013/0068184 A1* 3/2013 Tada ..... 123/90.17

FOREIGN PATENT DOCUMENTS

WO WO 2009/009328 A1 1/2009
WO WO 2009009328 A1 * 1/2009

OTHER PUBLICATIONS

Corresponding International Search Report with English Translation dated Jun. 6, 2011(five (5) pages).
Form PCT/ISA/237 (seven (7) pages), dated Jul. 31, 2009.

* cited by examiner

CAMSHAFT WITH CAMSHAFT ADJUSTER

BACKGROUND AND SUMMARY OF THE INVENTION

The invention relates to a camshaft for actuating the gas exchange valves of an internal combustion engine, having a camshaft tube, a hydraulic camshaft adjuster, a valve for controlling the hydraulic fluid supplied to the camshaft adjuster and an actuating device disposed in the interior of the camshaft tube for actuating the valve which is secured in the axial direction to prevent displacement.

PCT International Publication No. WO 2009/009328 A1 discloses a camshaft having an actuating device formed as an electromagnet (solenoid) that does not rotate along with the camshaft tube when the camshaft rotates. The solenoid is disposed so as to always be fixed to the cylinder head, i.e., it is fixedly connected to the cylinder head of the engine. Two different embodiments are described, showing how the solenoid can be disposed in the interior of the camshaft. In accordance with a first embodiment, the solenoid is mounted via a bearing element disposed in the interior of the camshaft tube and is fixedly connected to the cylinder head of the engine via a tubular connecting element and an end piece. Reference is made to the fact that the connecting element ("tubular shaft" or "torque tube" 116) can also be used for guiding cables for supplying current to the solenoid. In accordance with a second embodiment, the solenoid has an increased length compared with the first embodiment and is itself directly attached to the cylinder head/engine block of the engine which means that there is no need to provide the bearing element required for the first embodiment or to provide the tubular connecting element.

The solutions for disposing the actuating device in the interior of the camshaft tube known from PCT International Publication No. WO 2009/009328 A1 have, inter alia, the disadvantage that virtually the entire interior of the camshaft tube is taken up either by the tubular connecting element (embodiment 1) or by the lengthened solenoid (embodiment 2) and thus cannot be used for the integration of further components (such as for example oil separating devices for purifying blow-by gas) or for other uses. Therefore, further functional elements can no longer be integrated into the interior of the camshaft tube. In the case of embodiment 1, innerworking of the camshaft tube is also required due to the bearing element disposed in the interior of the camshaft tube, in order to satisfy the high precision requirements for proper accommodation of the bearing. The total weight of the known camshaft is also high due to the connecting and bearing elements for holding the solenoid or the increased length of the solenoid.

A further disadvantage of the solutions known from PCT International Publication No. WO 2009/009328 A1 is that due to the holding and connecting elements, by means of which the actuating device is held in the interior of the camshaft tube and is connected to the cylinder head, an oil pump or vacuum pump is not disposed on the end of the camshaft opposite the camshaft adjuster and cannot be driven via the camshaft.

Exemplary embodiments of the present invention provide a camshaft for actuating the gas exchange valves of an internal combustion engine having a low weight and in which in addition to the actuating device and possibly the valve still further functional elements can also be integrated into the interior of the camshaft. It should also be possible to dispose an oil or vacuum pump—which can be driven by the camshaft—on the end of the camshaft opposite the camshaft adjuster.

In accordance with the invention, the actuating device for actuating the valve is formed as an electromagnetic or piezoelectric actuating device and is connected to the camshaft tube in a rotationally-fixed manner. Therefore, the actuating device in the present invention rotates along with the camshaft and no separate holding and connecting elements for holding the actuating device in the camshaft tube and for attaching it to the cylinder head are required. It is also not necessary to increase the length of the actuating device in the axial direction in order to attach it directly, i.e., without separate holding and connecting elements, to the cylinder head/engine block. The interior of the camshaft tube located next to the actuating device remains free and can be used for incorporating other functional elements into the camshaft or for other uses.

Considerable weight savings are achieved because separate holding and connecting elements are no longer needed and the actuating device no longer needs to be lengthened in the axial direction and be directly attached to the cylinder head/engine block. A bearing element disposed in the interior of the camshaft tube for accommodating the actuating device is not required in the solution in accordance with the invention which means that in this respect weight and costs (in particular material and production costs) are also saved by the invention.

In the case of the invention, an oil or vacuum pump—which can be driven by the camshaft—can readily be disposed on the end of the camshaft opposite the camshaft adjuster. As a result, the designer has more options for exploiting the drive energy provided by the camshaft rotation compared with the solution known from the Prior Art.

In accordance with one embodiment of the invention, the actuating device is press-fitted into the interior of the camshaft in a non-positive locking manner or in a positive locking manner or in a non-positive and positive locking manner. In this case, the actuating device cannot be removed from the camshaft tube, or can only be done so with a great deal of difficulty, when it is defective for example. If the actuating device is defective, generally the entire camshaft must then be replaced. In order to avoid this, provision can be made in accordance with the invention to form the connection between the actuating device and the camshaft tube as a releasable connection. Such a releasable connection can be for example a latching connection or a screw connection.

In order to be able to supply current to the actuating device, current supplying means are provided in the interior of the camshaft tube and are connected thereto in a rotationally-fixed manner. These means can be formed for example as electric lines which are connected on the one hand to the camshaft tube and on the other hand to the actuating device.

In accordance with one embodiment of the invention, the current is fed to the current supplying means via elements connected to the camshaft tube in a rotationally-fixed manner. These elements can be disposed for example on the outer periphery of the camshaft tube or in the interior of the camshaft tube. For instance, the elements can be formed for example as annular brushes, slip rings or induction coils.

Stationary means can be allocated to the elements connected to the camshaft tube in a rotationally-fixed manner, wherein by virtue of the stationary means the current for powering the actuating device is transferred to the elements rotating along with the camshaft or is inducted in these elements. These stationary means can be formed for example as stationary brushes, sliding contacts or electromagnetic coils.

In terms of the current transfer, provision can be made in accordance with the invention that the elements connected to the camshaft tube in a rotationally-fixed manner comprise transmitter elements and the stationary means comprise sensor elements of a camshaft position determining device. In this manner, the components required for the current transfer can simultaneously be used to form a position determining device for determining the rotational position of the camshaft which is in any case required for most applications.

In accordance with a further embodiment of the invention, the valve is also disposed in the interior of the camshaft tube and is connected thereto in a rotationally-fixed manner. Owing to the fact that the valve is also integrated into the interior of the camshaft tube, the actuation of the valve by the actuating device is facilitated and the axial constructional space required for the camshaft can be further reduced.

BRIEF DESCRIPTION OF THE DRAWING FIGURES

Figure 4:
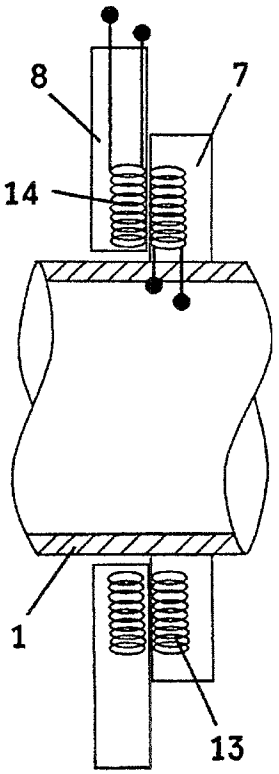
Figure 3:
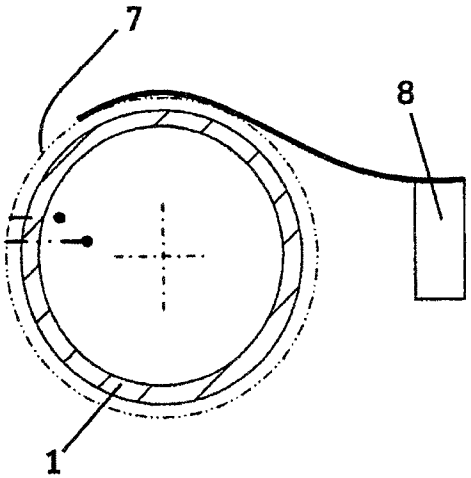
Figure 2:
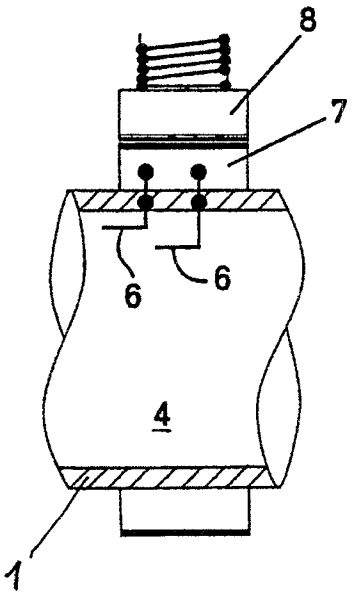
Figure 5:
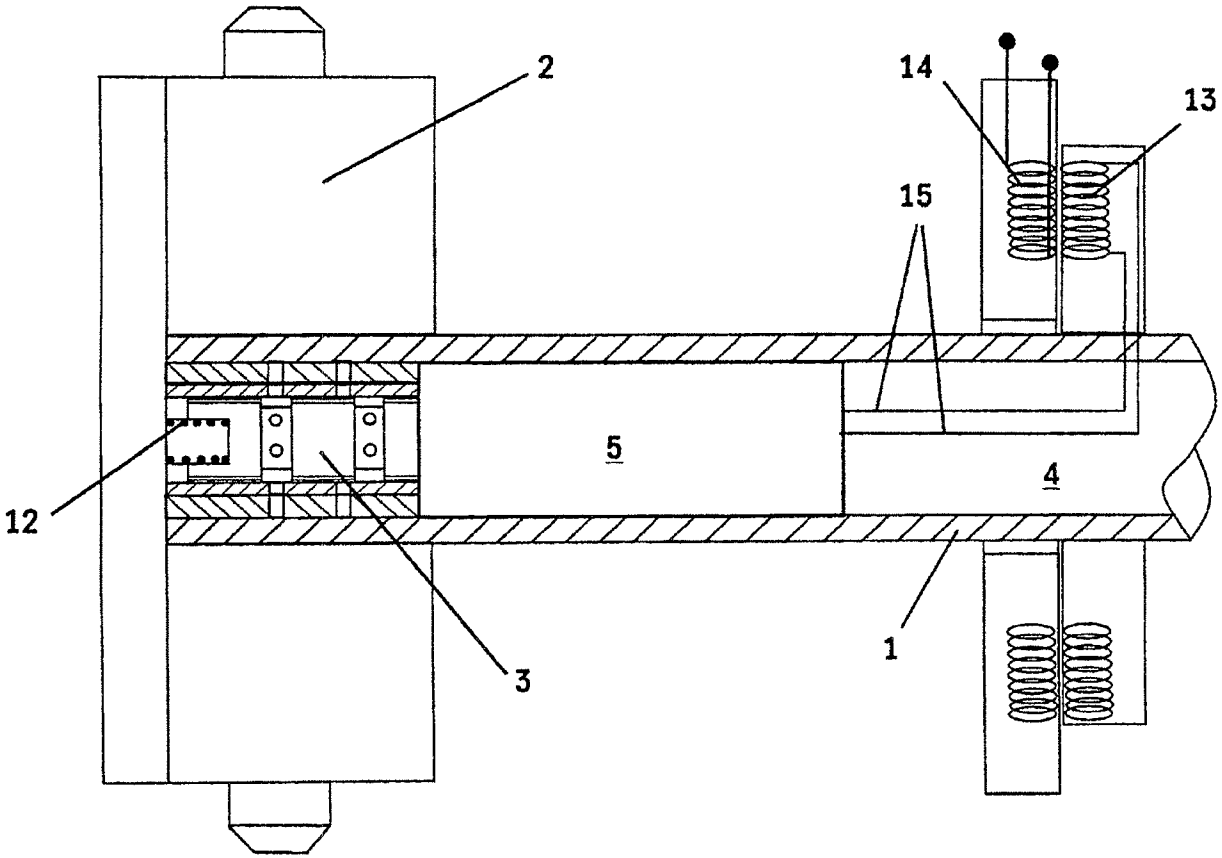
Figure 6:
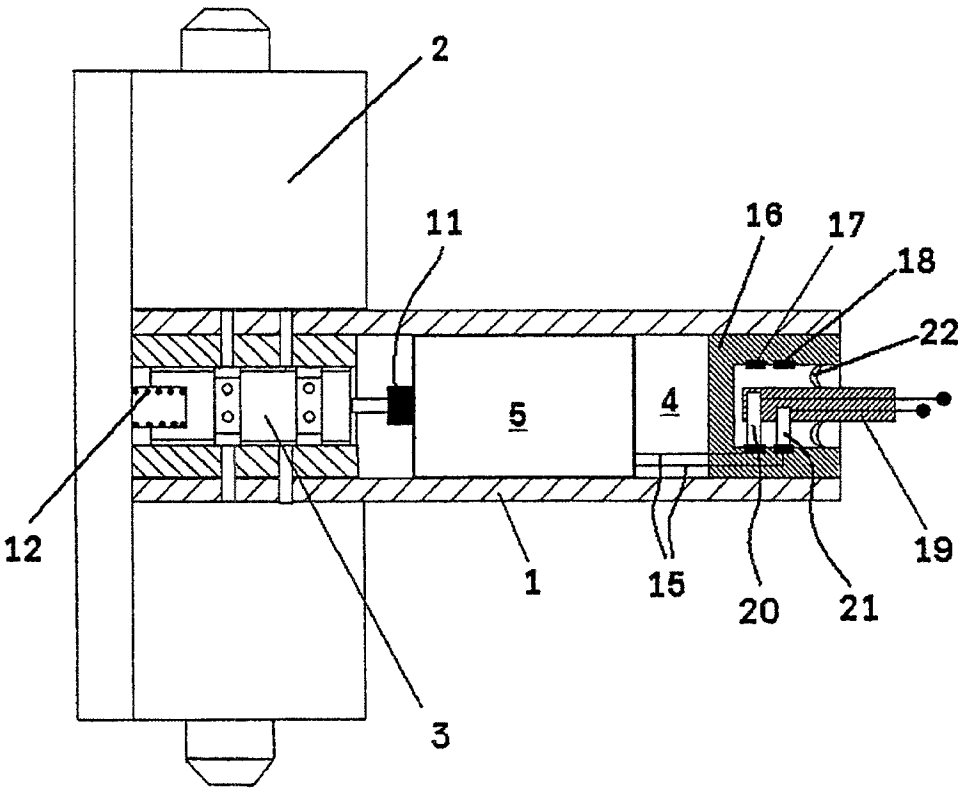
Figure 7:
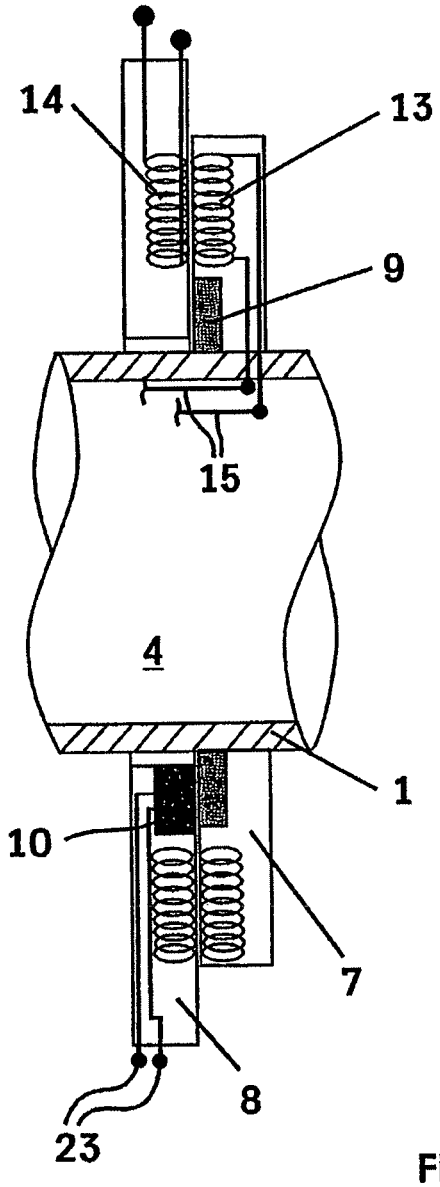

The invention will be explained in detail hereinafter with the aid of a drawing illustrating an exemplified embodiment. In detail:

FIG. 1 shows an axial half-section of a camshaft in accordance with the invention, FIG. 2 shows a first current-supplying option for supplying current to the actuating device, FIG. 3 shows a second option for supplying current to the actuating device, FIG. 4 shows a third option for supplying current to the actuating device, FIG. 5 shows a camshaft in accordance with the invention in a different embodiment from that of FIG. 1, FIG. 6 shows a camshaft in accordance with the invention in a different embodiment from those of FIG. 1 and FIG. 5, FIG. 7 shows a camshaft in accordance with the invention having a camshaft position determining device integrated into the current supplying device.

DETAILED DESCRIPTION

FIG. 1 shows an axial half-section of a camshaft in accordance with the invention. A hydraulic camshaft adjuster 2 is disposed on the end of the camshaft tube 1 on the left-hand side in FIG. 1 in a manner known per se. Such camshaft adjusters comprise drive elements that are connected directly or indirectly to the crankshaft of the internal combustion engine and are driven thereby. Furthermore, such known camshaft adjusters comprise adjusting elements that are connected to the camshaft tube 1 and can be rotated relative to the drive elements by hydraulic actuation in order to effect phase adjustment of the camshaft relative to the crankshaft.

Such known camshaft adjusters 2 are controlled via hydraulic valves. This means that the hydraulic fluid effecting the adjustment is fed to a hydraulic camshaft adjuster via a hydraulic valve in an manner required for the desired adjustment. The hydraulic fluid is used to rotate the part of the camshaft adjuster 2—connected to the camshaft tube 1 in a rotationally-fixed manner—relative to the part of the camshaft adjuster 2 driven by the crankshaft.

In the case of the camshaft in accordance with the invention as shown in FIG. 1, the hydraulic valve 3 is disposed in the interior 4 of the camshaft and is connected to the camshaft tube 1 in a rotationally-fixed manner.

The actuating device 5 actuating the hydraulic valve 3 is also disposed in the interior 4 of the camshaft tube 1 and is connected thereto in a rotationally-fixed manner. In accordance with the invention, the actuating device 5 is formed as an electromagnetic or piezoelectric or electric actuator.

Since the actuating device 5 is connected to the camshaft tube 1 in a rotationally-fixed manner, there is no need to provide separate attachment devices by means of which the actuating device is indirectly or directly connected to the engine block/cylinder head of the engine. The entire interior 4 of the camshaft tube 1 extending from the actuating device 5 to the right in FIG. 1, i.e., towards the camshaft end opposite the camshaft adjuster, remains free which means that for example further functional elements of a camshaft can be integrated into this free area of the interior 4. For example, it would be feasible in this case to integrate an oil separating device for separating oil from so-called blow-by gas. However, other usage options for the interior 4 which remains free are possible in the case of the camshaft in accordance with the invention.

In the embodiment in accordance with FIG. 1, the actuating device 5 has been press-fitted into the camshaft tube 1, which means that it is connected to the camshaft tube 1 in a non-positive locking and/or positive locking manner. Alternatively, the connection between the actuating device 5 and the camshaft tube 1 can also be designed as a releasable connection. In this case, the actuating device 5 can form for example with the inner wall of the camshaft tube 1 a clearance fit and can be axially fixed by a fixing element incorporated into the camshaft tube 1 or co-operating therewith. Such a fixing element can be a snap ring, which, for example, is inserted into a corresponding groove in the inner wall of the camshaft tube 1. A latching lug on the actuating device that engages into a corresponding recess in the camshaft tube 1 would also be feasible. However, these embodiments of the invention are not illustrated in FIG. 1.

A releasable connection between the actuating device 5 and the camshaft tube 1 has the advantage that the actuating device 5 can be easily replaced if it becomes damaged. In this case it is not necessary to replace the entire camshaft.

The actuating device 5 connected to the camshaft tube 1 in a rotationally-fixed manner is supplied with current via current supplying means 6 connected to the camshaft tube 1 in a rotationally-fixed manner. These means are only schematically illustrated in FIG. 1. In the illustrated exemplified embodiment, the current is supplied from the radial direction from outside the camshaft tube 1. The current supplying means 6 can be formed and disposed in various ways. Further details in this regard can be found hereinafter.

The actuating device 5 comprises an actuating pin 11. The actuating pin 11 is displaced in the axial direction in dependence upon the strength of the current supplied to the actuating element 5 or upon the voltage applied to the actuating element 5. The actuating pin 11 acts upon a control piston, which can be displaced in the axial direction, of the hydraulic valve 3 by means of which the hydraulic fluid fed to the camshaft adjuster is in turn controlled. The actuating pin 11 acts against a return spring 12 by means of which the control piston of the valve 3 is pushed or pulled back into a starting position when no force is exerted on the control piston by the actuating pin 11.

FIG. 2 illustrates a first option for supplying the required current can to the actuating device 5. In this embodiment of the invention, the current supplying means 6 are connected to an element 7 connected to the camshaft tube 1 in a rotationally-fixed manner. The element 7 is formed as a brush element rotating along with the camshaft. A stationary means 8 is allocated to the element 7, by virtue of which stationary means the current for powering the actuating device 5 is transferred to the element 7. The means 8 in accordance with the embodiment of FIG. 2 is a brush element disposed in a stationary manner.

In the embodiment illustrated in FIG. 3, a current supplying device that is different from that of FIG. 2 is provided. The element 7 connected to the camshaft tube 1 in a rotationally-fixed manner is formed as a slip ring. The slip ring co-operates with a means 8 allocated thereto, which is formed as a sliding contact.

A different current supplying device is in turn provided in the embodiment in accordance with FIG. 4. In the case of this exemplified embodiment, the current required for the actuating device 5 is generated by induction. The element 7 connected to the camshaft tube 1 in a rotationally-fixed manner comprises a first induction coil 13. A stationary means 8 is allocated to the element 7 and likewise comprises a coil 14 that can be supplied with current. The relative movement between the element 7 and the means 8 during a rotational movement of the camshaft tube 1 generates the current required for the actuating device 5 by induction in the first induction coil 13.

The options for supplying current to the actuating device 5 illustrated in FIGS. 2, 3 and 4 are shown merely by way of example. Other arrangements and designs for the current supplying devices are feasible. The current does not have to be supplied in the radial direction, it can also be supplied in the axial direction. Furthermore, the current supplying means can also be integrated into the interior 4 of the camshaft tube 1 and the current can be supplied in the axial direction.

FIG. 5 illustrates an exemplified embodiment of the invention that is modified compared with FIG. 1. In this embodiment of the invention, the actuating device 5 is formed in one piece with the hydraulic valve 3. This means that the housing of the actuating device 5 is formed in one piece with the housing of the valve 3 or that these two housings are formed at least as a built-up component that can be pre-assembled prior to installation into the camshaft. As a result, a relatively simple assembly can be achieved. Furthermore, it is possible for the control piston of the hydraulic valve 3 not to be actuated via an actuating pin 11 of the actuating device 5, as illustrated in FIG. 1, but for the control piston of the valve 3 to be fixedly connected to the armature of the electromagnetic actuating device 5, or for the control piston of the valve 3 to itself form the armature of the electromagnetic actuating device 5. The actuating device 5 is supplied with current via lines 15 connected to the camshaft tube 1 in a rotationally-fixed manner. A first induction coil 13 is disposed on the outer side of the camshaft tube 1 in a rotationally-fixed manner. The first induction coil 13 rotates together with the camshaft tube 1 relative to a second coil 14 that is disposed in a stationary manner and has current passing through it. In this manner, the current required for actuating the actuating device 5 is generated by induction in the induction coil 13 and is supplied to the actuating device via the lines 15.

FIG. 6 shows one embodiment of the invention, wherein the current is supplied to the actuating device 5 in the axial direction. A slip ring sleeve 16 is inserted into the interior 4 of the camshaft tube 1 in a rotationally-fixed manner. The slip ring sleeve 16 comprises slip rings 17, 18. A stationary line supply 19 is disposed inside the slip ring sleeve 16 and is in contact with the peripheral slip rings 17, 18 via sliding contacts 20, 21. The line supply 19 comprises current-carrying wires via which the current required for controlling the actuating device 5 is supplied to the sliding contacts 20, 21. The control current is transferred to the lines 15 and supplied to the actuating device 5 via the slip rings 17, 18.

The line supply 19 is kept centralised in the interior of the slip ring sleeve 16 via an annular element 22. The annular element 22 can optionally comprise a seal with respect to oil (e.g., from the area surrounding the camshaft). The annular element 22 can also be formed as a bearing, e.g., as a roller bearing. An element 22 formed as a bearing can also include a sealing element which means that in addition to the bearing function, a sealing function is also fulfilled.

In the case of the camshaft in accordance with the invention, it is advantageously possible in a particularly simple manner to integrate a camshaft position determining device, which is in any case necessary in many applications, into the current supplying device for supplying current to the actuating device 5. This is illustrated by way of example in FIG. 7 using the example of the inductive current supplying device in accordance with FIGS. 4, 5.

A transmitter element 9 is integrated into the element 7, connected to the camshaft tube 1 in a rotationally-fixed manner, having the first induction coil 13. The transmitter element 9 that also rotates can be e.g., a stepped metallic sensor ring such as for example a so-called trigger wheel basically known from the Prior Art. Alternatively, the sensor ring can be formed e.g., from synthetic material having cast-in metallic particles or as a sensor ring consisting of synthetic material having integrated metallic segments.

In addition to the second current-influenced induction coil 14, a sensor element 10 is integrated into the means 8 that is disposed in a stationary manner and is allocated to the element 7 connected to the camshaft tube 1 in a rotationally-fixed manner. Known camshaft position sensors such as for example so-called Hall sensors or magneto-resistive position sensors can be considered as the sensor element 10. Depending upon the embodiment of the transmitter element 9, other sensor elements can also be used. In terms of the invention, it is not important which transmitter element or which sensor element or which combination of transmitter element and sensor element is used, but rather that the transmitter element and the sensor element are integrated into the elements 7 and means 8 of the current supplying device. A separate camshaft position determining device is thus not necessary.

The sensor element 10 disposed in the stationary means 8 is connected to an evaluation and control unit, not illustrated, via lines 23.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

LIST OF REFERENCE NUMERALS

1 Camshaft tube
2 Camshaft adjuster
3 Valve
4 Interior
5 Actuating device
6 Current supplying means
7 Element
8 Means
9 Transmitter element
10 Sensor element
11 Actuating pin
12 Return spring
13 Induction Coil
14 Coil

15 Lines
16 Slip ring sleeve
17 Slip ring
18 Slip ring
19 Line supply
20 Sliding contact
21 Sliding contact
22 Element
23 Lines

The invention claimed is:

1. A camshaft for actuating the gas exchange valves of an internal combustion engine, the camshaft comprising:

a camshaft tube having an interior surface;

a hydraulic camshaft adjuster;

a valve configured to control hydraulic fluid supplied to the camshaft adjuster; and an actuating device disposed in an interior of the camshaft tube, the actuating device configured to actuate the valve, wherein the actuating device is secured in the axial direction to prevent displacement, wherein the actuating device is an electromagnetic, piezoelectric or electric actuator, and wherein the actuating device is secured to the interior surface of the camshaft tube so that the actuating device is connected to the camshaft tube in a rotationally-fixed manner.

2. The camshaft as claimed in claim 1, wherein the connection between the actuating device and the camshaft tube is a releasable connection.

3. The camshaft as claimed in claim 1, further comprising:

current supplying means for supplying current to the actuating device provided in the interior of the camshaft tube, wherein the current supplying means is connected to the interior of the camshaft tube in a rotationally-fixed manner.

4. The camshaft as claimed in claim 3, comprising further elements connected to the camshaft tube in a rotationally-fixed manner, wherein current is suppliable to the current supplying means via the further elements.

5. The camshaft as claimed in claim 4, further comprising:

stationary means are allocated to the further elements, the stationary means are connected to the camshaft tube in a rotationally-fixed manner, by virtue of which stationary means the current for powering the actuating device is transferred to the further elements or is induced in the further elements.

6. The camshaft as claimed in claim 5, wherein the further elements comprise transmitter elements and the stationary means comprise sensors elements of a camshaft position determining device.

7. The camshaft as claimed in claim 1, wherein the valve is disposed in the interior of the camshaft tube and the valve is connected to the interior of the camshaft tube in a rotationally-fixed manner.

* * * * *